US005179924A

United States Patent [19]

Manaka

[11] Patent Number: 5,179,924

[45] Date of Patent: Jan. 19, 1993

[54] METHOD AND APPARATUS FOR CONTROLLING AIR-FUEL RATIO IN INTERNAL COMBUSTION ENGINE

[75] Inventor: Toshio Manaka, Ingolstadt, Fed. Rep. of Germany

[73] Assignee: Hitachi, Ltd., Tokyo, Japan

[21] Appl. No.: 708,227

[22] Filed: May 31, 1991

[30] Foreign Application Priority Data

Jun. 1, 1990 [JP] Japan ..... 2-141397

[51] Int. Cl.[5] ..... F02D 41/14

[52] U.S. Cl. ..... 123/682; 123/688

[58] Field of Search ..... 123/198 D, 440, 489, 123/479; 73/23.32

[56] References Cited

U.S. PATENT DOCUMENTS 4,177,787 12/1979 Hattori et al. ..... 123/489 X
4,844,038 7/1989 Yamato et al. ..... 123/479
4,887,576 12/1989 Inamoto et al. ..... 123/479

FOREIGN PATENT DOCUMENTS 119450 5/1987 Japan .

*Primary Examiner*—Tony M. Argenbright
*Attorney, Agent, or Firm*—Antonelli, Terry, Stout & Kraus

[57] ABSTRACT

In an air-fuel ratio control method and apparatus for an internal combustion engine supplied with a gas mixture of air and fuel, in which an actual air-fuel ratio is determined from exhaust gas components by using an $O_2$-sensor installed in an exhaust pipe of the engine, and the air-fuel ratio of the mixture gas to be supplied to the engine is controlled through feedback control on the basis of deviation of the actually detected air-fuel ratio from a reference value (A/F=14.7). Performance of the $O_2$-sensor is determined by making use of change in the air-fuel ratio output of the $O_2$-sensor at a time of interruption of the fuel supply to the engine or at a time the fuel supply to the engine is restarted.

8 Claims, 8 Drawing Sheets

HIGH
ENGINE ROTATION NUMBER (rpm)
N
NFC
NRC
0

OPENING DEGREE OF THROTTLE
FULLY OPENED
O
to
0
FULLY CLOSED
t1

INJECTION PULSE DURATION (ms)
0

O2 CORRECTING COEFFICIENT
1.0
0.9
IR
PL
PR
IL

OUTPUT VOLTAGE OF O2-SENSOR (V)
RICH
1.0
0.5
0
LEAN
Vmax
V3
V2
Voo
VSL
V1
Vo1
Vmin
V4
Δto
Δt34
Δt12

METHOD AND APPARATUS FOR CONTROLLING AIR-FUEL RATIO IN INTERNAL COMBUSTION ENGINE

BACKGROUND OF THE INVENTION

The present invention generally relates to a method and an apparatus for controlling the air-fuel ratio of a gas mixture of air and fuel supplied to an internal combustion engine through a feedback control by utilizing the output of an air-fuel ratio sensor. More particularly, the invention is concerned with an air-fuel ratio control method and apparatus which are capable of detecting malfunction or degratation of the air-fuel ratio sensor.

In conjunction with the control of the fuel supplied to cylinders of an internal combustion engine, there has been heretofore known and adopted extensively in practical applications a method of controlling the air-fuel ratio of the mixture gas supplied to the engine through feedback control as well as an apparatus for carrying out the method based on the detection of the intake air amount and the air-fuel ratio detected by an air-fuel ratio sensor (such as $O_2$-sensor or the like) installed in an exhaust pipe of the internal combustion engine.

By the way, increasing interest concerning environmental problems and reinforced regulations concerning the exhaust emission of motor vehicles as well as activities directed to improvement of fuel-cost performance of the motor vehicle in recent years require more accurate control of the air-fuel ratio and appropriate detection of unsatisfactory operations or malfunctions of various detecting devices employed in the control of the air-fuel ratio.

As an approach for satisfying the demand mentioned above, there has been proposed a method of determining the performance of an exhaust gas concentration detector, such as an $O_2$-sensor for the purpose of judging or detecting the unsatisfactory operation or malfunction of the $O_2$-sensor which is employed for detecting the actual air-fuel ratio by sensing the concentration of oxygen contained in the exhaust gas of the internal combustion engine, as is disclosed in JP-A-62-119450. According to this prior art sensor performance or function diagnosis method, the air-fuel ratio of the fuel gas mixture supplied to the engine is varied in the manner of a rectangular waveform, wherein the response rate of the $O_2$-sensor detected upon change of the air-fuel ratio is determined. More specifically, a time lag $T_{RL}$ in the output of the $O_2$-sensor produced the fuel concentration of the mixture gas supplied to the engine changes from a low to a high level is compared with a time lag $T_{LR}$ accompanying the output of the $O_2$-sensor produced upon change of the fuel concentration from a high to a low level, whereon a decision is made on the basis of the result of comparison as to whether or not the $O_2$-sensor is operating satisfactorily.

The prior art $O_2$-sensor performance diagnosis or decision method described above is however disadvantageous in that the torque generated by the internal combustion engine is subjected to significant variation because of a remarkable change (from 13.1 to 16.1) of the air-fuel ratio of the mixture gas supplied to the engine upon making a decision concerning the performance of the air-fuel ratio sensor. As a consequence, when the decision of sensor performance is carried out in the course ordinary running of a motor vehicle equipped with the internal combustion engine of concern, the driver feels a shock to his or her senses, which in turn means that the maneuverability of the motor vehicle is degraded. For this reason, a restriction or limitation is necessarily imposed on the timing for making a decision as to the performance of the air-fuel ratio sensor, giving rise to a problem.

SUMMARY OF THE INVENTION

In the light of the state of the art described above, it is an object of the present invention to provide a method of controlling the air-fuel ratio of a mixture gas supplied to an internal combustion engine, which method allows the performance or functioning of an air-fuel ratio sensor to be decided at an optimal timing in the course of the running of a motor vehicle without affecting adversely the maneuverability of the vehicle. With the invention, it is also contemplated to provide an air-fuel ratio control apparatus for carrying out the method.

In view of the above and other objects which will be apparent as this description proceeds, there is provided according to an aspect of the invention a method of controlling the air-fuel ratio of a gas mixture of air and fuel supplied to an internal combustion engine, in which an actual air-fuel ratio is determined on the basis of exhaust gas components exhausted from the engine by using an air-fuel ratio detecting sensor installed in an exhaust gas system of the engine, the air-fuel ratio of the mixture gas to be supplied to the engine being controlled through a feedback control on the basis of a difference or deviation of the actually detected air-fuel ratio from a reference value thereof. The control method further comprises a step of a decision concerning the performance or functioning of the air-fuel ratio detecting sensor on the basis of change in the air-fuel ratio detection output of a the air-fuel ratio sensor at the time of interruption or restart of the fuel supply to the internal combustion engine.

According to another aspect of the invention, there is provided an air-fuel ratio control apparatus for an internal combustion engine which comprises a system for supplying a gas mixture of air and fuel to the internal combustion engine, an air-fuel ratio detecting sensor installed in an exhaust system of the engine for detecting an actual air-fuel ratio, and a controller for controlling through a feedback control the air-fuel ratio of the gas mixture supplied from the system on the basis of a difference or deviation of the actually detected air-fuel ratio from a reference value thereof, wherein the controller is further so arranged as to make a decision concerning the performance or functioning of the air-fuel ratio detecting sensor by making use of a detected change in the air-fuel ratio detection output of the air-fuel ratio sensor at the time of interruption or restart of the fuel supply through the fuel gas mixture supplying system.

With the method and apparatus for controlling the air-fuel ratio in an internal combustion engine according to the invention, a decision as to whether the air-fuel ratio sensor for detecting the actual air-fuel ratio is operating satisfactorily (i.e. whether the sensor suffers from a malfunction) can be made at the time of interruption (cut) of the fuel supply to the internal combustion engine or restart of the fuel supply. By virtue of this feature, a shock otherwise felt by the driver due to the forced variation of the air-fuel ratio of the gas mixture supplied to the engine in the manner of a rectangular waveform can be avoided, while allowing a decision as to the performance of the air-fuel ratio sensor to be made with an enhanced reliability.

DESCRIPTION OF THE PREFERRED EMBODIMENTS

Now, the present invention will be described in detail in conjunction with preferred or exemplary embodiments of a method of controlling air-fuel ratio in an internal combustion engine (hereinafter also referred to as the engine for short) and an apparatus for carrying out the method.

Figure 2:
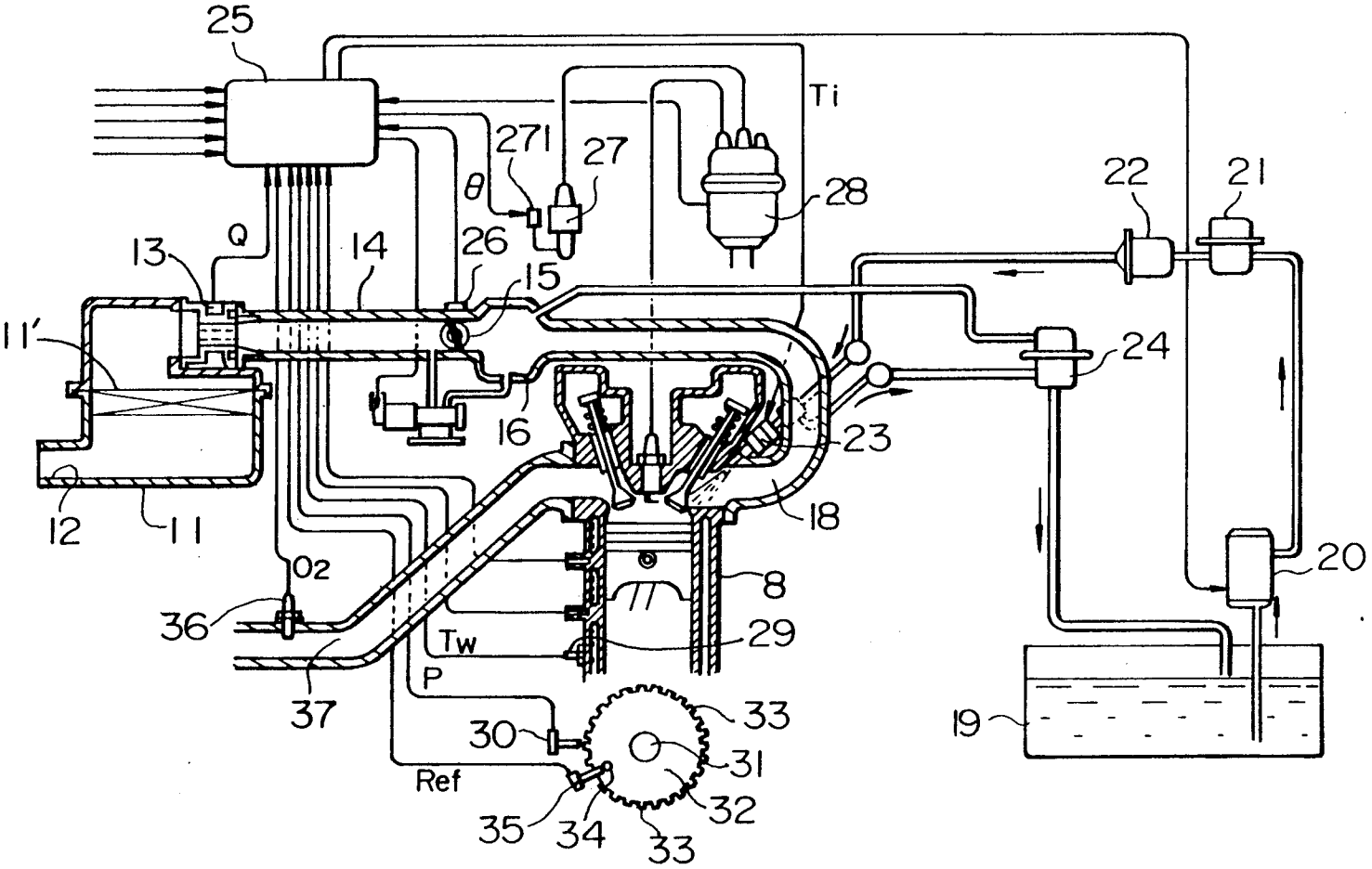
FIG. 2 is a schematic view showing generally a structure of an internal combustion engine to which the air-fuel ratio control of gas mixture according to the invention is applied.

At the beginning, description will be directed to a general arrangement of the air-fuel ratio control apparatus. Referring to FIG. 2, the air introduced through an inlet port 12 of an air cleaner 11 flows through a filter 11' of the air cleaner 11 and then passes through an air flow meter 13, for example, of a hot wire type which serves for detecting the amount of intake air flow. In succession, the air flows through a duct 14 and a throttle valve 15 disposed downstream of the air flow meter 13 to enter a so-called collector 16, wherein the throttle valve 15 serves for controlling the amount of intake air flow. Through the collector 16, the air is distributed to intake tubes 18 each connected to an associated cylinder of a multi-cylinder engine 8, resulting in the air is being sucked into the respective cylinders of the engine 8.

On the other hand, the fuel is fed from a fuel tank 19 to a fuel pump 20 to be pressurized thereby and introduced subsequently to fuel inlet ports of fuel injection valves 23 after having passed through a fuel damper 21 and a fuel filter 22. Further, a part of the fuel flow to be introduced to the injection valve 23 through the fuel filter 22 is branched to a fuel pressure regulator 24 to be fed back to the fuel tank 19. Owing to the function of the fuel pressure regulator 24, the pressure of the pressurized fuel supplied to the injection valve 23 is controlled to be substantially constant, whereon the pressurized fuel is injected into the intake tube 18 through the fuel injection valve 23. In the case of the illustrated embodiment, the fuel injection valve 23 is mounted in a wall of the intake tube 18 at a position in the vicinity of an intake port of the associated engine cylinder, whereby a multi-point injection system (MPI in abbreviation) is implemented for controlling the amount of fuel supply to each of the cylinders of the multi-cylinder engine through the fuel injection valves provided for the cylinders, respectively.

In FIG. 2, a reference numeral 29 denotes a water temperature sensor for detecting the temperature ($T_w$) of water which serves for cooling the engine 8.

Proceeding with description of the instant embodiment of the invention, an electric output signal Q generated by the air flow meter 13 and representing the intake air flow or amount is inputted to a control unit 25 which will hereinafter be described in detail. The throttle valve 15 includes a rotatable shaft on which a so-called throttle sensor 26 is mounted for detecting the opening degree of the throttle. An output signal $\theta$ of the throttle sensor 26 is also inputted to the control unit 25. In FIG. 2, a reference numeral 28 denotes a distributor.

The internal combustion engine 8 is further provided with a crank angle sensor 30 for detecting the angle of rotation of the engine. The crank angle sensor 30 may be disposed in opposition to a metal crank disk 32 mounted on a crank shaft 31 of the engine 8 and having an outer periphery formed with teeth 33 at a predetermined angular equidistance for generating an output pulse signal P representing proportionally the angle of rotation of the crank shaft 31, as is shown in FIG. 2. Also formed on a side surface of the crank disk 32 is a projection 34 in opposition to which a reference angle sensor 35 is installed for generating a reference position signal $R_{ef}$ at every predetermined rotational angle of the engine. The outputs of the crank angle sensor 30 and the reference angle sensor 35 are inputted to the abovementioned control unit 25 as well.

Further referring to FIG. 2, a so-called $O_2$-sensor 36 is disposed internally of an exhaust pipe 37 for the purpose of detecting the actual air-fuel ratio of the gas mixture supplied to the engine. More specifically, the $O_2$-sensor 36 detects the concentration of oxygen contained in the exhaust gas and produces an output signal having an amplitude varying in dependence on the $O_2$-concentration relative to a reference value (corresponding to the air-fuel ratio of 13.4). The output signal $O_2$ of this $O_2$-sensor is also inputted to the control unit 25. The control unit 25 performs predetermined arithmetic processings on the signals derived from the various sensors mentioned above and representing the operation or running state of the engine for driving various actuators to thereby realize an optimal control of the engine operating state. By way of example, the control unit 25 may control with control signals outputted therefrom a power transistor unit 271 which is mounted on a lateral side of an ignition coil 27 for controlling a firing high-voltage by turning on/off the ignition coil 27, the fuel injection valves 23 for injecting the fuel to the associated engine cylinders, respectively, and operation of the fuel pump 20, as can also be seen from FIG. 2.

Figure 3:
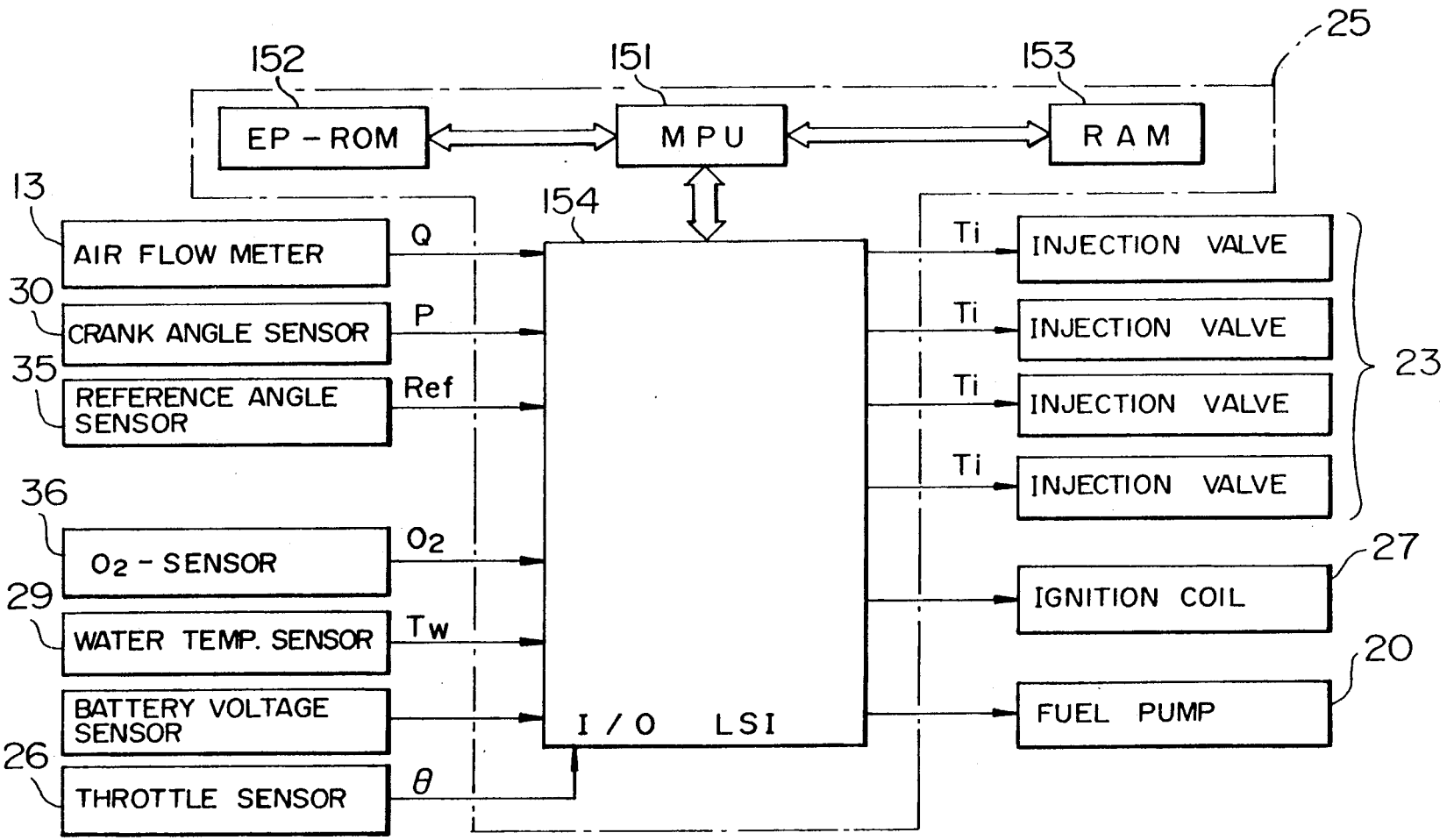
FIG. 3 is a block diagram showing generally a circuit configuration of the control apparatus according to the invention.

Now referring to FIG. 3, the control unit generally denoted by a numeral 25 is composed of a multiprocessor unit (MPU) 151, a rewritable nonvolatile memory (electrically programmable read-only memory or EPROM for short) 152, a random access memory (RAM) 153 and an LSI input/output (I/O) circuit 154 for receiving as inputs the signals representing the engine operation or running state and detected by the various sensors described above and outputting control signals for driving the various actuators. More specifically, the LSI I/O circuit 154 is supplied with the output signals from the air flow meter 13, the crank angle sensor 30, the reference angle sensor 36, the $O_2$-sensor 36, the water temperature sensor 29, a battery voltage sensor (not shown in FIG. 2) and the throttle sensor 26 through internal analogue-to-digital (A-D) converters incorporated in the LSI I/O circuit or through external A-D converters, as the case may be. Subsequently, predetermined arithmetic operations are performed through cooperation of the MPU 151, EPROM 152 and the RAM 153 for thereby controlling operations of the fuel injection valve 23, the power transistor unit 271 of the ignition coil 27, the fuel pump 20 and other which serve as the actuators for controlling the engine, as in the case of the internal combustion engine equipped with the air-fuel ratio control system known heretofore.

Figures 1A, 1B, 1C, 1D, 1E:
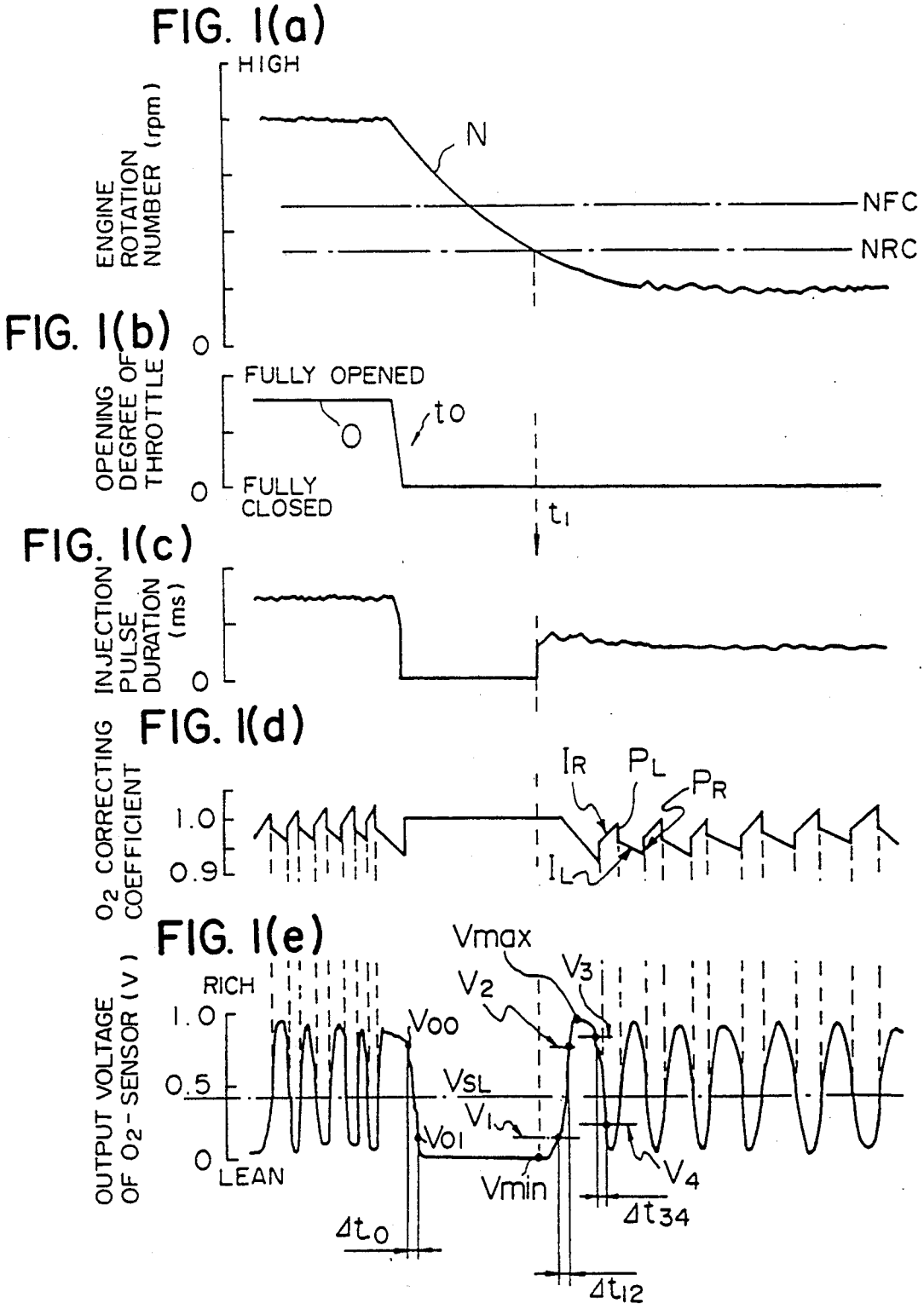
FIGS. 1(*a–e*) show waveform diagrams for illustrating operation of the air-fuel ratio control method and apparatus according to an exemplary embodiment of the invention.

FIG. 1 shows timing charts for illustrating the concept underlying the air-fuel ratio control method and operation of the control apparatus according to the illustrated embodiment of the invention.

It is now assumed that a driver releases an accelerator pedal for decelerating a motor vehicle equipped with the engine to be controlled in accordance with the teaching of the invention. Then, the magnitude of the output signal $\theta$ of the throttle sensor 26 representing the opening degree of the throttle valve 15 is steeply decreased at the start of deceleration (at a time point $t_0$), as can be seen from a waveform (b) shown in FIG. 1. Correspondingly, the rotation number N of the engine is lowered, as illustrated at (a) in FIG. 1.

In the meanwhile, the control apparatus detects at the time point $t_0$ the full opening of the throttle valve on the basis of variation in the throttle sensor signal $\theta$, determines the deceleration when the engine rotation number N is greater than a preset value NFC (i.e. $N > NFC$), and sets to zero the pulse width or duration $T_i$ of the injection pulse signal used for actuating the injection value which is in charge of the control of fuel supply, to thereby interrupt or cut the fuel supply, as illustrated at (c) in FIG. 1 (interruption of the fuel supply).

Subsequently, when the engine rotation number N decreases below a preset value (NRC) (i.e. when $N < NRC$), determination of the deceleration is invalidated (at a time point $t_1$), resulting in that the fuel injection is restarted (restart of the fuel supply), as shown at (c) in FIG. 1.

With the present invention, a decision is made as to whether the air-fuel ratio detector for detecting the actual air-fuel ratio on the basis of the contents of the engine exhaust gas (e.g. oxygen concentration) operates satisfactorily or not by taking advantage of the interruption of the fuel supply and the restart of the fuel supply. In this regard, it should be noted that, in the deceleration control phase in which the fuel supply is decreased to zero, as described above, a determination can be made as to the satisfactory or unsatisfactory operation of the air-fuel ratio detector in the course of ordinary running operation of the motor vehicle without sacrificing the maneuverability thereof.

Typical one of the $O_2$-sensors for which decision is made as to the performance thereof is designed to produce an output voltage in a range of 0.8 to 1.0 volts (referred to as the high level output) when the air-fuel ratio (A/F ratio) of the gas mixture supplied to the internal combustion engine is smaller than the theoretical air fuel ratio ($A/F = 14.7$), indicating that the gas mixture is rich, while the $O_2$-sensor outputs a voltage in a range of 0 to 0.1 volt (low level output) when the actual air fuel ratio is higher than the theoretical value, indicating that the gas mixture is lean. When the performance characteristic of the $O_2$-sensor is deteriorated, the difference between the maximum value of the high level output and the minimum value of the low level output becomes smaller, which means that the response characteristics of the $O_2$-sensor are degraded.

Figure 4A:
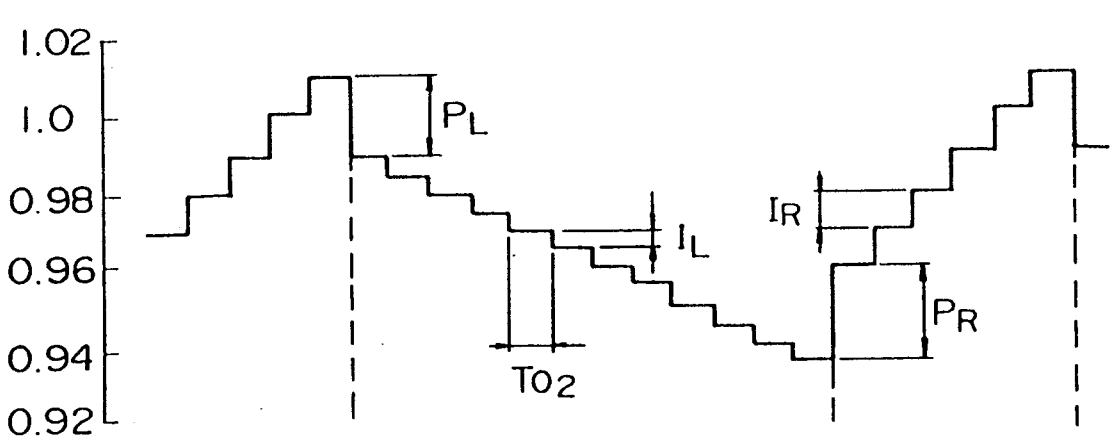
FIGS. 4(*a*) and 4(*b*) are a timing chart for illustrating an operation of the control apparatus.
Figure 4B:
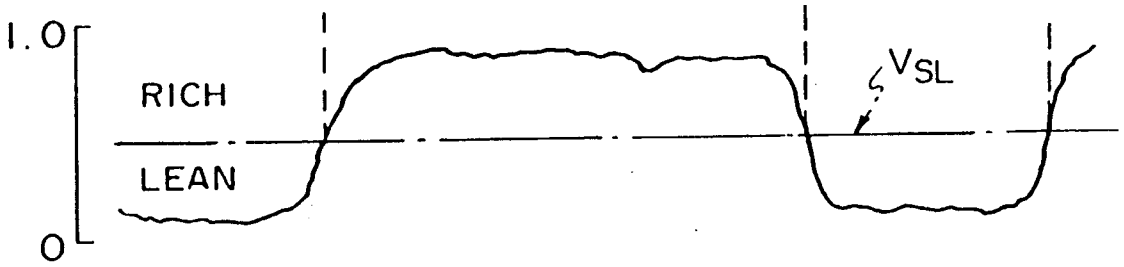

Description will now be turned to the air fuel ratio control of the gas mixture supplied to the internal combustion engine equipped with the $O_2$-sensor of the type described above. As illustrated in FIG. 4 at (*a*) and (*b*), when the output of the $O_2$-sensor 36 is of low level, indicating that the gas mixture is lean, an $O_2$ correcting coefficient $\alpha$ employed for shortening or lengthening the injection pulse width $T_i$ is progressively increased each by a predetermined value $I_R$ (corresponding to an integral part of control gain in a feedback control) to thereby enrich gradually the gas mixture supplied to the engine. Subsequently, when the air-fuel ratio of the gas mixture supplied to the engine becomes smaller than the theoretical air-fuel ratio A/F mentioned above (represented by a voltage $V_{SL}$), indicating that the gas mixture becomes rich, the output voltage of the $O_2$-sensor 36 transits toward the high output level. In correspondence to the change in the output state of the $O_2$-sensor mentioned above, the $O_2$ correcting coefficient $\alpha$ is decreased by a value $P_L$ which is referred to as a proportional part of the control gain, being then followed by gradual decrementation by a value $I_L$ which corresponds to an integral part of the control gain at the time when the $O_2$-correcting coefficient $\alpha$ is decreased and which is smaller than the value $P_L$. When the actual air-fuel ratio again becomes higher than the theoretical air-fuel ratio, resulting in the output voltage of the $O_2$-sensor becoming lower than the reference voltage $V_{SL}$, indicating that the gas mixture is lean, the $O_2$ correcting coefficient $\alpha$ is incremented by a value $P_R$ (proportional part of the control again), which is then followed by gradual incrementation by a value $I_R$ (an integral part of the control gain at the time when the $O_2$ correcting coefficient is increased). The control procedure described above is activated at every predetermined time interval $T_{02}$ in the course of execution of a control program.

According to the present invention, a decision is made as to the performance of the $O_2$-sensor 36 at the time of interruption and restart of the fuel supply to the engine as described previously, wherein when it is found that the $O_2$-sensor 36 is degraded, a corresponding message is issued to the driver or other person of concern (by lighting, for example, an alarm lamp or the like) or the control gain of the feedback control mentioned above is adjusted appropriately in accordance with the response sensitivity or rate desired for the $O_2$-sensor.

In the following, a description will be made in detail of the air-fuel ratio control method and the control apparatus according to the invention, the general concept of which has been elucidated above.

Figure 5:
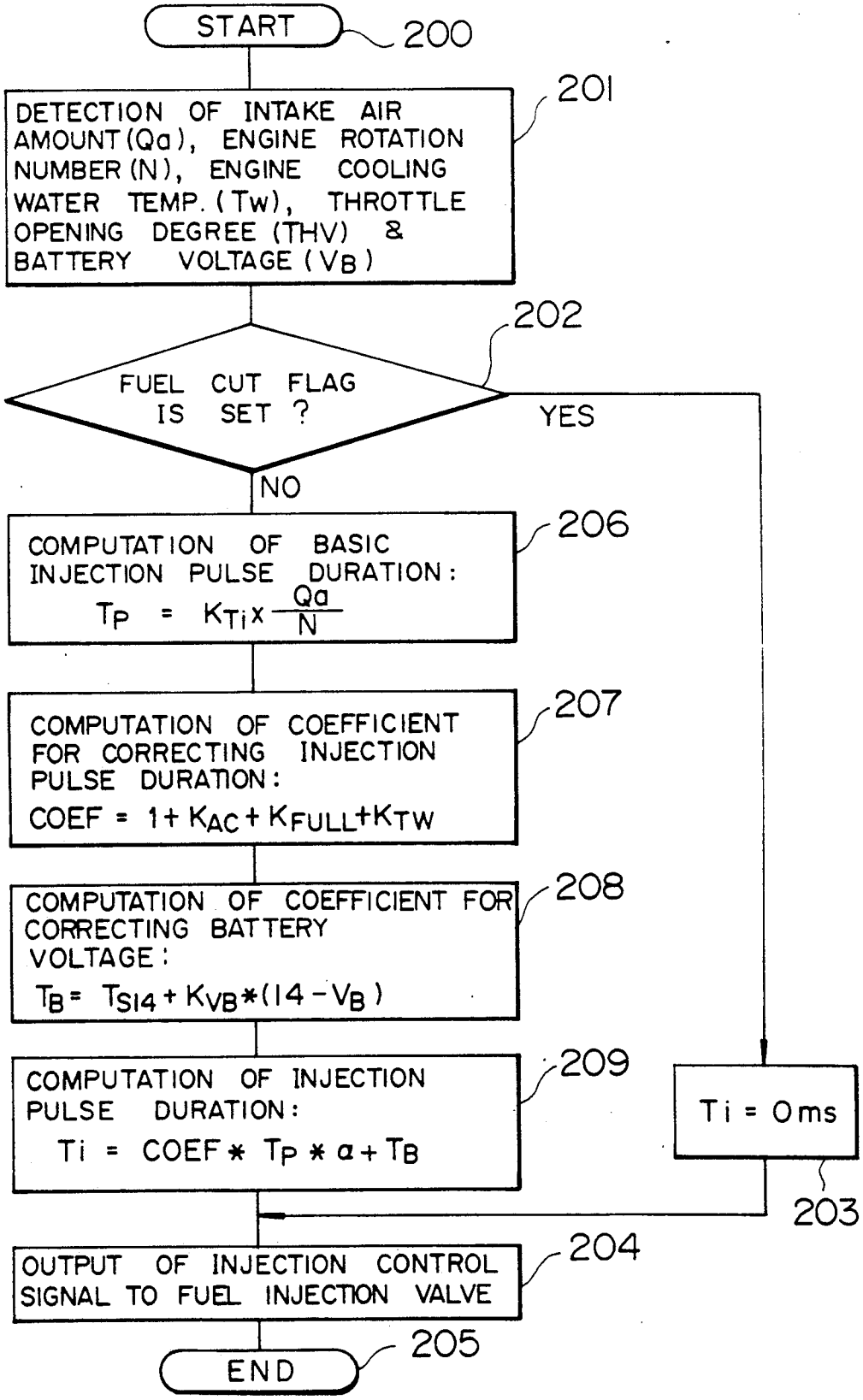
FIGS. 5 to 7 show flow charts for illustrating a program executed by the control apparatus.

FIG. 5 is a flow chart for illustrating the operation carried out by the control apparatus according to an embodiment of the invention with the aid of a control program for controlling the fuel injection pulse signal which in turn controls the fuel supply amount injected through the fuel injection valve. The illustrated program is activated at every predetermined time interval and is effective for determining the pulse width or duration $T_i$ of the injection pulse supplied to the fuel injection valve 23.

More specifically, referring to FIG. 5, upon activation (step 200), the intake air flow $Q_a$, engine rotation number N (rpm), temperature $T_W$ of engine cooling water, throttle opening degree THV and the battery voltage $V_B$ are detected and fetched (step 201). Subsequently, a fuel cut flag indicating the interruption or cut-off of the fuel supply is checked as to whether it is set or not (step 202). When the flag is set (i.e. when the answer resulting from the step 202 is "YES"), the injection pulse width $T_i$ is set to zero (i.e. $T_i=O_{ms}$) at a step 203, whereon the injection control signal is outputted to the fuel injection valve 23 (step 204). The processing then comes to an end (steps 205).

On the other hand, unless the fuel cut flag is set at the decision step 202 (the result of which is thus NO), the basic injection pulse width $T_P$ is arithmetically determined in accordance with the following expression (1) at a step 206.

$$T_P=K_{Ti}*(Q_a/N) \quad (1)$$

where $K_{Ti}$ represents a constant determined by a flow characteristic of the fuel injection valve.

Next, an injection pulse width correcting coefficient COEF is calculated at a step 207 in accordance with the following expression (2).

$$\mathrm{COEF}=1+K_{AC}+K_{FULL}+K_{TW} \quad (2)$$

where $K_{AC}$ represents a fuel amount increase correcting coefficient at the time when the throttle valve is rapidly opened for acceleration, $K_{FULL}$ represents a fuel amount increase correcting coefficient when the throttle valve is fully opened, and $K_{TW}$ represents a fuel amount increase correcting coefficient when the engine cooling water temperature $T_W$ is low. Subsequently, a voltage correcting pulse width $T_B$ for a battery constituting the power supply for driving the fuel injection valves is arithmetically determined at a step 208 in accordance with the following expression (3).

$$T_B=T_{S14}+K_{VB}*(14-V_B) \quad (3)$$

where $T_{S14}$ represents the correcting pulse width when the battery voltage $V_B$ is 14 volts, and $K_{VB}$ represents a constant.

Thereafter, by using the basic injection pulse width $T_P$, the correcting coefficients COEF and $T_B$ and the $O_2$ correcting coefficient $\alpha$ determined as described above, the fuel injection pulse width or duration $T_1$ is determined at a step 209 in accordance with $$T_i=\mathrm{COEF}*T_P*\alpha+T_B$$

The fuel injection pulse signal of the pulse duration $T_i$ thus determined is then supplied to the fuel injection valve.

Figure 6:
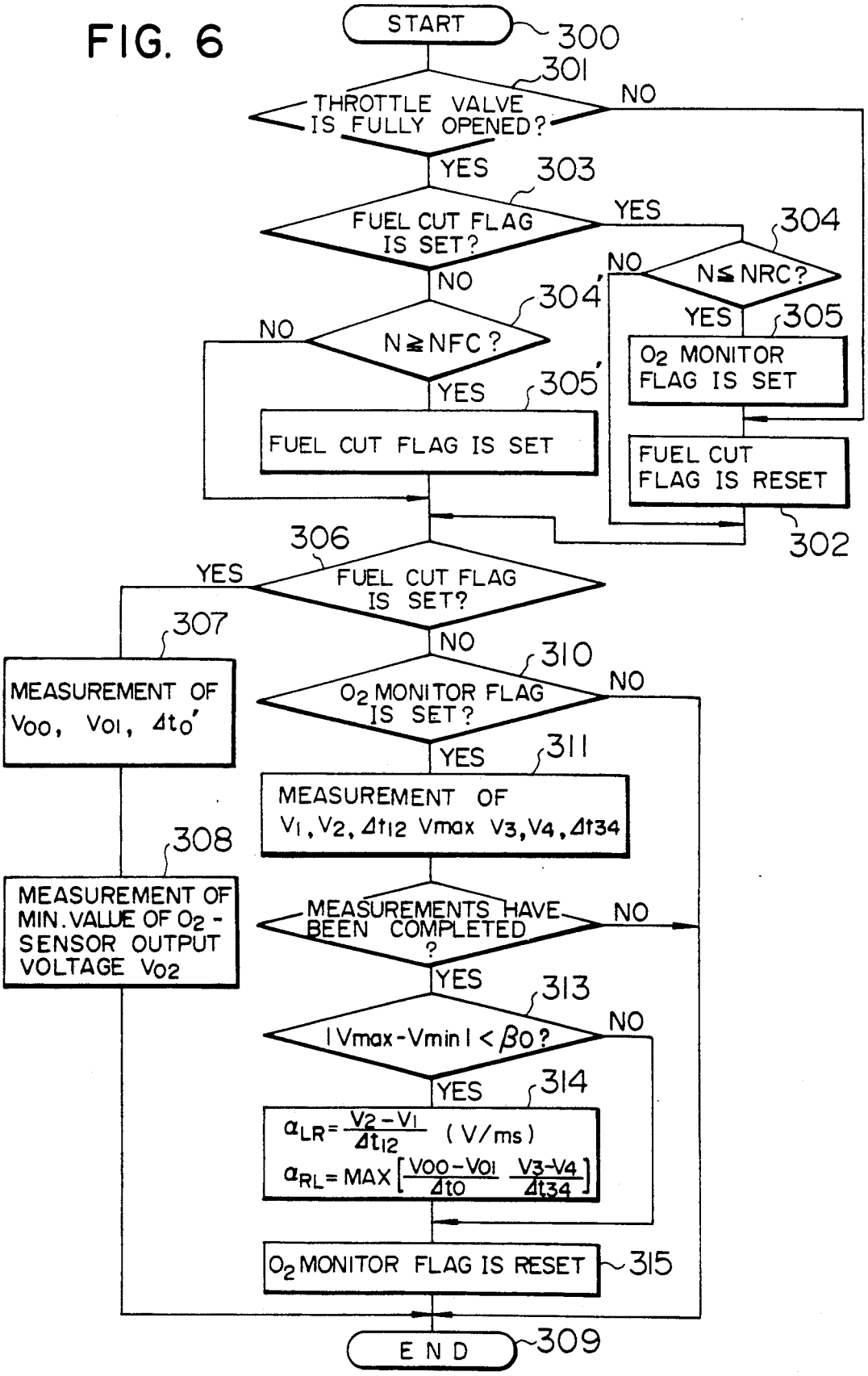

FIG. 6 shows a program for performing the decision as to the fuel supply interruption, interruption (cut) of the fuel supply and decision as to the performance of the $O_2$ sensor upon restart of the fuel supply. This program is equally implemented as a timer-interrupted program activated at every predetermined time interval $T_{01}$. In the following, operation of the program shown in FIG. 6 will be described by referring to the timing charts or waveform diagrams (a) to (e) illustrated in FIG. 1 as well.

Upon activation of the program (step 300), a throttle opening signal $\theta$ (FIG. 1 (*c*)) is checked to decide whether or not the throttle valve is fully opened (step 301). When the answer of this decision step 301 is negative (NOT), i.e. when it is decided that the throttle valve is not fully opened, the processing proceeds to a step 302 where the fuel cut flag is reset. Stated in another way, the fuel supply interruption (fuel cut) is cleared to restart the fuel supply.

On the other hand, when the result of the abovementioned decision step 301 is affirmative (YES), i.e. when the throttle valve is fully opened, the processing proceeds to a step 303 where it is decided whether the fuel cut flag is set or not. When the answer of the decision step 301 is "YES", then decision is made as to whether or not the engine rotation number N (FIG. 1, (*a*)) is smaller than a predetermined value NRC (i.e. whether $N<NRC$) at a step 304. If the result of this decision step 304 is negative (NO), the processing then branches to a program for determining the performance of the $O_2$-sensor, which will be described later on. On the other hand, when the decision step 304 results in "YES", an $O_2$-monitor flag indicating monitoring of the output of the $O_2$-sensor is set (step 305), after which the fuel cut flag is reset (step 302).

When the answer of the abovementioned decision step 303 is negative (NO), i.e. unless the fuel cut flag is set, it is then checked at a step 304' whether the engine rotation number N (FIG. 1, (*a*)) is equal to or greater than the predetermined rotation number NFC (i.e. $N\geqq NFC$). In case the check results in affirmative answer (YES), then the fuel cut flag is set at a step 305'. On the other hand, when it is "NO", the processing proceeds to a next program by skipping the step 305'.

At a next step 306, the fuel cut flag is checked as to whether it is set or not. In case the fuel cut flag is set (i.e. when the result of the check step 306 is "YES"), the $O_2$-sensor output voltages $V_{00}$ and $V_{01}$ as well as an intervening time $\Delta t_0$ (see FIG. 1 at (*e*)) are measured at a step 307, which is then followed by measurement of the minimum value $V_{min}$ of the $O_2$-sensor output voltage $V_{02}$ (see FIG. 1 at (*e*)) at a step 308, whereupon the processing comes to an end (step 309).

On the other hand, when the result of the decision step 306 is "NO", i.e. unless the fuel cut flag is set, it is then checked at a step 310 whether the $O_2$ monitor flag is set or not. When the result of this check is "NO", the processing is then terminated (step 309). Contrarily, in case the $O_2$ monitor flag is set (i.e. when the result of the step 310 is "YES"), values $V_1$, $V_2$, $\Delta t_{12}$, $V_3$, $V_4$ and $\Delta t_{34}$ of the output voltage of the $O_2$-sensor are measured at a step 311. Unless it is decided at the step 312 that the abovementioned measurement is not yet completed (i.e. when "NO" results from the step 312), execution of the program is terminated (step 309). If otherwise, the processing proceeds to a next step.

More specifically, a step 313 is then executed to make decision as to whether or not magnitude of the swing or amplitude ($V_{max}-V_{min}$) of the $O_2$-sensor output voltage for which measurement has been completed is smaller than a predetermined value $\beta_0$ (i.e. $V_{max}-V_{min}<\beta_0$). When the result of the decision indicates that the amplitude ($V_{max}-V_{min}$) is greater than the predetermined value $\beta_0$, it is determined that the $O_2$-sensor has not undergone deterioration, whereon the processing comes to an end (step 309).

On the other hand, when the amplitude ($V_{max}-V_{min}$) is smaller than the predetermined value $\beta_0$, this means that the characteristic of the $O_2$-sensor has undergone degradation. In that case, the response rates $\alpha_{LR}$ and $\alpha_{RL}$ are arithmetically determined at a succeeding step 314. At first, the rising-up edge response rate $\alpha_{LR}$ (V/ms) of the $O_2$-sensor (i.e. rate of rising-up of the $O_2$-sensor output voltage) is determined in accordance with the following expression, $$\alpha_{LR}=(V_2-V_1)/\Delta t_{12} \quad (4a)$$

Further, the falling edge response rate $\alpha_{LR}$ (V/ms) of the $O_2$-sensor (i.e. rate of falling of the $O_2$-sensor output voltage) is determined in accordance with the following expression:

$$\alpha_{RL}=\mathrm{MAX}[(V_{00}-V_{01})/\Delta t_0, (V_3-V_4)/\Delta t_{34}] \quad (4b)$$

More specifically, the falling edge response rate $\alpha_{RL}$ of the $O_2$-sensor is determined as the higher one of the rate $\alpha_{RL}$ given by $(V_{00}-V_{01})/\Delta t_0$ and the falling edge response rate $\alpha_{RL}$ which makes appearance in immediate succession to the restart of the injection pulse generation at the time point $t_1$ (see step 314 in FIG. 6). Thereafter, the $O_2$ monitor flag is reset at a step 315, whereupon execution of the program comes to an end (step 309).

Figure 7:
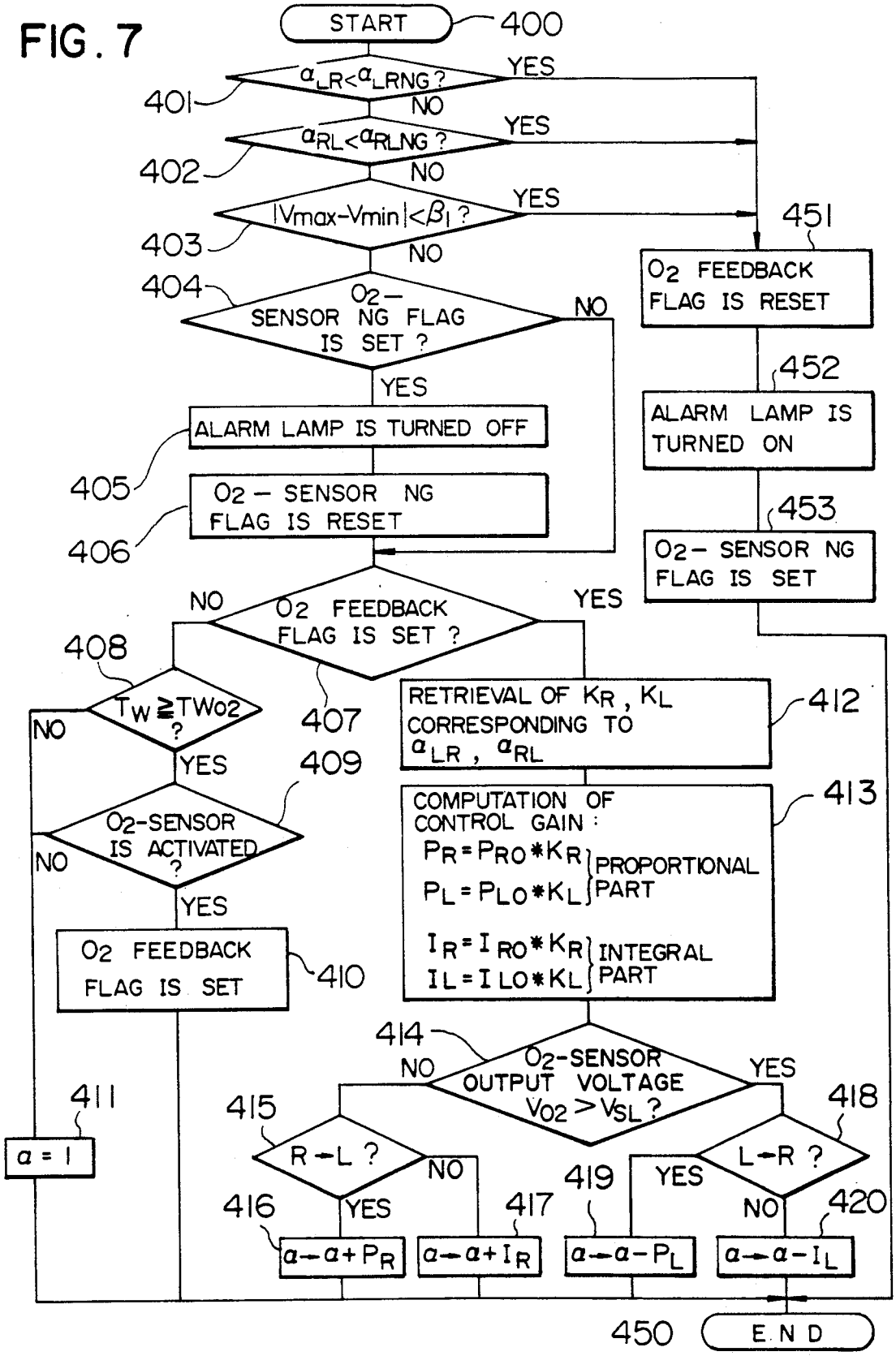

FIG. 7 is a flow chart for illustrating a method of performing actually the fuel control on the basis of the result of the decision made as to deterioration of the $O_2$-sensor as described above, wherein an alarm lamp is lit, if necessary, while the gain involved in the air-fuel ratio feedback control is corrected. The program prepared to this end is also of a timer interrupt type adapted to be activated for execution at every predetermined time interval $T_{02}$.

Figure 8:
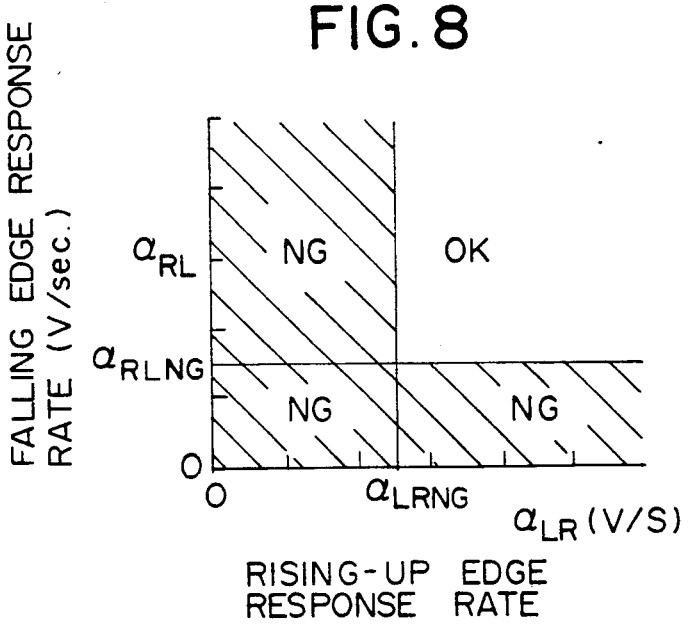
FIG. 8 is a view illustrating graphically relation existing between the response rates of an $O_2$-sensor and deterioration thereof.

In general, as the $O_2$-sensor undergoes deterioration in the course of time lapse, the $O_2$-sensor exhibits a trend that the response rates thereof becomes low with the amplitude of the sensor output voltage being also decreased. With the program now under consideration, it is contemplated to detect degradation of the $O_2$-sensor by taking advantage of the abovementioned trend. More specifically, referring to FIG. 7, when the program is activated (step 400), it is first checked whether or not the rising-up edge response rate $\alpha_{LR}$ of the $O_2$-sensor determined in the manner as described previously is smaller than a predetermined reference value $\alpha_{LRNG}$ (step 401). Subsequently, in addition to the check of the rising-up edge response rate $\alpha_{LR}$ of the $O_2$-sensor, the falling edge response rate $\alpha_{RL}$ is also checked as to whether it is lower than a reference value $\alpha_{LRNG}$ (step 402). At a next step 403, it is further checked whether or not the amplitude $|V_{max}-V_{min}|$ of the sensor output signal is smaller than a predetermined value $\beta_1$. At this juncture, it should be mentioned that the reference values $\alpha_{LRNG}$ and $\alpha_{RLNG}$ are experimentally determined and set previously and bear such relationship as illustrated in FIG. 8. Further, the predetermined value $\beta_1$ is selected to be smaller than the value $\beta_0$ (i.e. $\beta_1<\beta_0$) mentioned hereinbefore in conjunction with the step 313 of FIG. 6.

Turning back to FIG. 7, when any one of the steps 401, 402 and 403 results in "YES", this indicates deterioration of the $O_2$-sensor. In that case, feedback control of the $O_2$-sensor is stopped and an $O_2$ feedback control flag is reset to generate an alarm (step 451). At a step 452, an alarm lamp is turned on (lit), whereon an $O_2$-sensor NG flag indicating that the $O_2$-sensor is not good (NG) is set at a step 453. Execution of the program then comes to an end (step 450).

On the other hand, when all the check steps 401, 402 and 403 result in "NO", indicating that no deterioration is found in the $O_2$-sensor, it is then checked at a step 404 whether or not the abovementioned $O_2$-sensor NG flag is set. In case this flag is set (YES), the alarm lamp is turned off to invalidate the alarm (step 405), whereon the $O_2$-sensor NG flag is rest (step 406) to allow the $O_2$ feedback control to be performed. Unless the $O_2$-sensor NG flag is set (i.e. when "NO" is resulted from the step 404), the $O_2$ feedback control is then performed at once.

In the $O_2$ feedback control, it is first checked whether or not an $O_2$ feedback flag is set at a step 407.

Unless the $O_2$ feedback flag is set (i.e. when the result of the step 407 is "NO"), it is then checked whether or not the temperature $T_W$ of engine cooling water is higher than a predetermined temperature $T_{W02}$ (step 408). When the result of this check is "YES", then the $O_2$-sensor is checked as to whether it is activated or not (step 409). In case the $O_2$-sensor is activated ("YES" output of the step 409), the $O_2$ feedback flag is set at a step 410 to allow the $O_2$-sensor feedback control to start, whereupon the processing comes to an end (step 450). On the other hand, when "NO" is resulted from the check steps 408 and 409, indicating that the $O_2$-sensor is not activated yet, the $O_2$ correcting coefficient $\alpha$ partaking in the $O_2$-sensor feedback control is set to 1.0 (i.e. $\alpha=1.0$) at a step 411, whereupon execution of the instant program is completed (step 450).

Figure 9A:
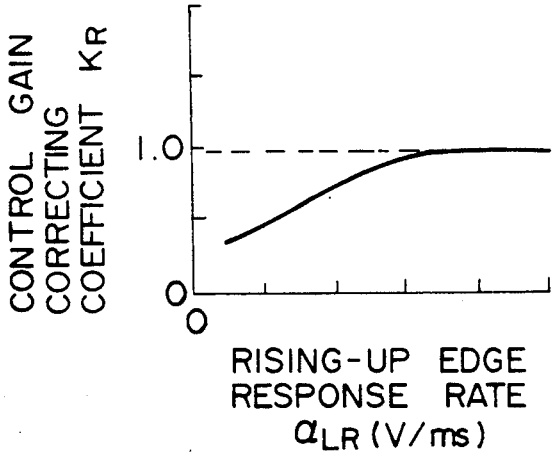
FIGS. 9A and 9B are views for graphically illustrating relations between the response rates of an $O_2$-sensor and control gain correcting coefficients involved in executing the program mentioned above.
Figure 9B:
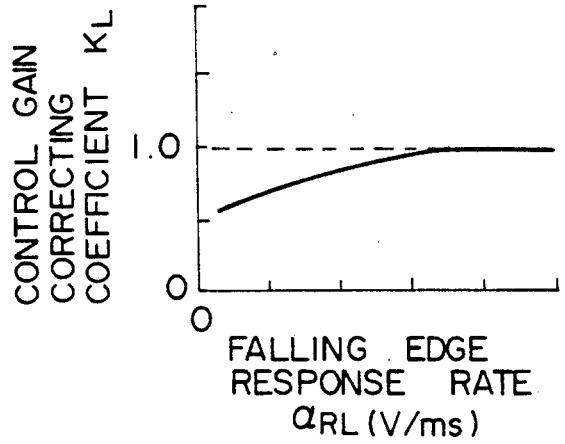

When the answer of the check step 407 is affirmative (YES), the gain involved in the $O_2$ feedback control is arithmetically determined on the basis of the previously mentioned response rates $\alpha_{LR}$ and $\alpha_{RL}$ of the $O_2$-sensor in a manner described below. At the beginning, control gain correcting coefficients $K_R$ and $K_L$ are retrieved or searched with the response rates $\alpha_{LR}$ and $\alpha_{RL}$ being used as parameters (step 412). In this conjunction, relations between the response rates $\alpha_{LR}$, $\alpha_{RL}$ and the correcting coefficients $K_R$, $K_L$ are such as illustrated in FIGS. 9A and 9B, by way of example, of which data may be stored in a ROM or the like in the form of a table.

Subsequently, proportional parts $P_R$, $P_L$ and integral parts $I_R$, $I_L$ in the $O_2$ feedback control are determined by using the retrieved correcting coefficients $K_R$, $K_L$ in accordance with $$P_R=P_{RO}*K_R \quad (5)$$

$$P_L=P_{LO}*K_L \quad (6)$$

$$I_R=I_{RO}*K_R \quad (7)$$

$$I_L=I_{LO}*K_L \quad (8)$$

where $P_R$ represents a proportional part when the correcting coefficient $\alpha$ is increased (i.e. when the fuel mixture is lean), $I_R$ represents an integral part when the correcting coefficient $\alpha$ is increased, $R_L$ represents a proportional part when the coefficient $\alpha$ is decreased (i.e. when the fuel mixture is rich) and $I_L$ represents an integral part when the correcting coefficient is decreased (refer to FIG. 4 at (*a*) and (*b*)). Further, $P_{RO}$, $P_{LO}$ and $I_{RO}$, $I_{LO}$ represent initial values of the above mentioned proportional and integral parts, respectively.

On the basis of the proportional parts and the integral parts as calculated, the $O_2$ feedback control is performed. To this end, it is first checked whether or not the $O_2$-sensor output voltage $V_{02}$ is higher than the voltage $V_{SL}$ representing the theoretical air-fuel ratio (step 414). When this step results in "NO" (indicating that the fuel mixture is lean), then decision is made as to whether the fuel mixture was determined to be rich in the preceding processing, i.e. whether or not the lean state detected currently follows immediately the rich state (step 415). When the decision at the step 415 results in "YES" (indicating the transition just made to the lean state immediately from the rich state), the $O_2$ correcting coefficient $\alpha$ is added with the proportional part $P_R$ (i.e. $\alpha=\alpha+P_R$), whereon the value of $\alpha$ is correspondingly updated (step 416). Execution of the program now comes to an end. On the other hand, when the result of the abovementioned decision (step 415) is "NO" (indicating that the current processing is other than the first processing following immediately to the transition from the rich to the lean state), the oxygen correcting coefficient $\alpha$ is added with the integral part $I_R$ (i.e. $\alpha=\alpha+I_R$) with the value of $\alpha$ being correspondingly updated, whereon the processing comes to an end.

In contrast, in case the result of the decision step 414 mentioned above results in "YES" (indicating that the fuel mixture is rich), then decision is equally made as to whether or not the current processing follows immediately the transition from the lean to the rich state (step 418). If so, the proportional part $P_L$ is subtracted from the correcting coefficient $\alpha$ (i.e. $\alpha=\alpha-P_L$), while otherwise the integral part $I_l$ is subtracted (step 420), whereupon execution of the program is completed.

As will now be appreciated from the foregoing description, with the air-fuel ratio control method and apparatus for internal combustion engines according to the invention, changes in the engine performances which accompany deterioration of the $O_2$-sensor can be monitored positively and accurately to thereby allow the optimal air-fuel ratio control to be realized on the basis of the result of the monitoring without sacrificing maneuverability of the motor vehicle, providing a great advantage.

I claim:

1. A method of controlling air-fuel ratio of a gas mixture of air and fuel supplied to an internal combustion engine, in which an actual air-fuel ratio is determined on the basis of exhaust gas components of said engine by using air-fuel ratio detecting means installed in an exhaust gas system of said engine, the air-fuel ratio of said gas mixture to be supplied to said engine being controlled through a feedback control on the basis of deviation of said actually determined air-fuel ratio from a reference value thereof, said control method comprising a step of making a decision as to performance of said air-fuel ratio detecting means by making use of a change in the air-fuel ratio detection output of said air-fuel ratio detecting means at the time of at least one of interruption and restart of the fuel supply to said internal combustion engine.

2. An air-fuel ratio control method according to claim 1, wherein the decision as to performance of said air-fuel ratio detecting means is made when the fuel supply to the engine is interrupted in a decelerating operation mode of a motor vehicle equipped with said engine.

3. An air-fuel ratio control method according to claim 1, wherein when the performance of said air-fuel ratio detecting means is decided to be unsatisfactory, a corresponding indication is generated.

4. An air-fuel ratio control method according to claim 1, wherein on the basis of the result of the decision as to the performance of said air-fuel ratio detecting means, gain involved in said feedback control is adjusted correspondingly.

5. Air air-fuel ratio control apparatus for an internal combustion engine, comprising:

means for supplying a gas mixture of air and fuel to said internal combustion engine;

air-fuel ratio detecting means installed in an exhaust system of said engine for detecting an actual air-fuel ratio; and means for controlling through a feedback control the air-fuel ratio of the mixture gas supplied from said gas mixture supplying means on the basis of deviation of said actual air-fuel ratio detected by said air-fuel detecting means from a reference value thereof, wherein said control means is further so arranged as to make a decision concerning performance of said air-fuel ratio detecting means by making use of a change in air-fuel ratio detection output of said air-fuel ratio detecting means at the time of at least one of interruption and restart of the fuel supply through said gas mixture supplying means.

6. An air-fuel ratio control apparatus according to claim 5, wherein said control means is constituted by a microcomputer.

7. An air-fuel ratio control apparatus according to claim 5, wherein said control means is so implemented as to make the decision concerning the performance of said air-fuel ratio detecting means when the fuel supply operation is performed in a decelerating operation mode of a motor vehicle equipped with said internal combustion engine.

8. An air-fuel ratio control apparatus according to claim 5, wherein said control means further includes means for adjusting gain involved in said feedback control on the basis of result of the decision made as to the performance of said air-fuel ratio detecting means.

* * * * *